United States Patent [19]

Kyogoku et al.

[11] Patent Number: 4,655,130

[45] Date of Patent: Apr. 7, 1987

[54] PRINTER

[75] Inventors: Hiroshi Kyogoku, Kawasaki; Mineo Nozaki; Masahiro Rachi, both of Tokyo, all of Japan

[73] Assignee: Canon Kabushiki Kaisha, Tokyo, Japan

[21] Appl. No.: 818,404

[22] Filed: Jan. 13, 1986

Related U.S. Application Data

[63] Continuation of Ser. No. 592,742, Mar. 23, 1984, abandoned, which is a continuation of Ser. No. 321,778, Nov. 16, 1981, abandoned, which is a continuation of Ser. No. 121,656, Feb. 15, 1980, abandoned, which is a continuation of Ser. No. 877,686, Feb. 14, 1978, abandoned.

[30] Foreign Application Priority Data

Feb. 28, 1977 [JP] Japan ..... 52-21294

[51] Int. Cl.[4] ..... B41J 1/30; B41J 9/04

[52] U.S. Cl. ..... 101/93.23; 101/75; 101/93.29; 400/145.2; 400/146; 400/154.4

[58] Field of Search ..... 101/75, 93.29, 93.23, 101/95; 400/145, 145.1, 145.2, 146, 154.4

[56] References Cited

U.S. PATENT DOCUMENTS 3,133,497 5/1964 Martin ..... 400/146

*Primary Examiner*—Clyde I. Coughenour

*Attorney, Agent, or Firm*—Fitzpatrick, Cella, Harper & Scinto

[57] ABSTRACT

A printer for printing characters on a recording medium includes, a printing drum provided on a first portion and a second portion of the outer periphery thereof respectively with a first set of type faces and a second set of type faces, the first set of type faces being adapted to print characters of odd or even digit positions in a row of characters to be printed while the second set of type faces is adapted to print remaining characters of even or odd digit positions in the row of characters to be printed, the top surface of each of the first and second sets of type faces being retracted from the outer periphery of the printing drum, and each face being provided with a resilient member on at least a part of circumference thereof; a hammer unit positioned in the printing drum and provided with a plurality of hammers, the hammers being adapted to selectively thrust faces of the first and second sets through the outer periphery of the printing drum to bring the hammers in pressure contact with the recording medium; a roller integral with the hammer unit and adapted to press the type faces of the first and second sets thereby causing the faces to project from the outer periphery of the printing drum; and an ink roller for applying ink onto the faces of the first and second sets maintained in projecting position by means of the roller.

9 Claims, 9 Drawing Figures

PRINTER

This application is a continuation of application Ser. No. 592,742 filed Mar. 23, 1984, now abandoned, which in turn is a cont. of U.S. Ser. No.: 321,778, filed Nov. 16, 1981, now abandoned, which in turn is a cont. of U.S. Ser. No.: 121,656, filed Feb. 15, 1980, now abandoned, which is a cont. of U.S. Ser. No.: 877,686, filed Feb. 14, 1978, now abandoned.

BACKGROUND OF THE INVENTION

1. Field of the Invention

The present invention relates to a printer requiring extremely low energy for printing and still being capable of maintaining a satisfactory print quality.

More specifically the printer of the present invention is capable of printing if supplied with enough mechanical energy for advancing the typeface so as to bring the same into pressure contact with a recording medium against the resilient force of a member provided around said typeface.

2. Description of the Prior Art

A considerable amount of printing energy is required in conventional printers because of the structure thereof wherein a hammer is actuated to come into pressure contact with a recording medium thereby deforming and bringing said medium into contact with a typeface wheel on which printing ink is applied. Also printers utilizing an ink ribbon require considerable energy for transferring carbon etc. from the ribbon to the recording medium. An elevated amount of energy is also required for rotating a rigid heavy typeface drum at a high velocity.

SUMMARY OF THE INVENTION

The object of the present invention, therefore, is to provide a printer requiring extremely low printing energy as at least a part around each typeface provided on a belt or a drum is composed of an organic elastic material such as rubber whereby printing is rendered possible by bringing said typeface, after ink application thereon, into pressure contact with a recording medium. Such reduced printing energy is preferable in achieving a higher printing speed and lower printing noise.

An another object of the present invention is to provide a printer capable of preventing undesirable ink deposition at the printing operation on a recording medium.

Other objects of the present invention will be rendered apparent from the following description of the preferred embodiments to be given with reference to the attached drawings.

DESCRIPTION OF THE PREFERRED EMBODIMENT

Figure 1:
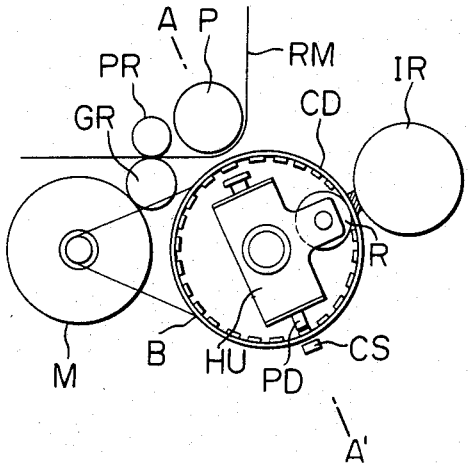
FIG. 1 is a lateral cross-sectional view of a printer of the present invention.
Figure 2:
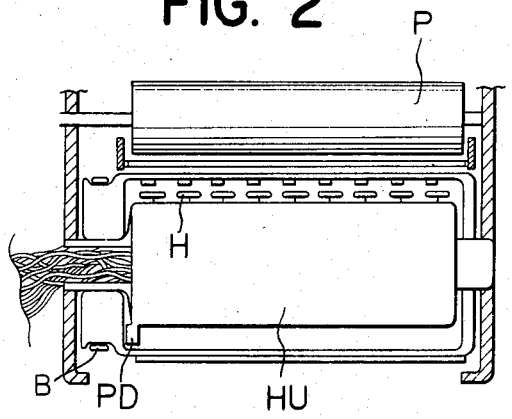
FIG. 2 is a cross-sectional view along the line A—A' in FIG. 1.
Figure 3A:
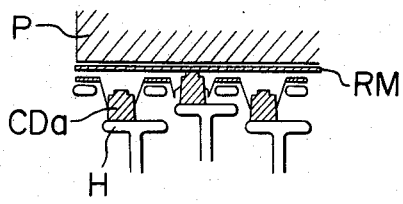
FIGS. 3(A) and 3(B) are enlarged partial views of FIG. 2.
Figure 3B:
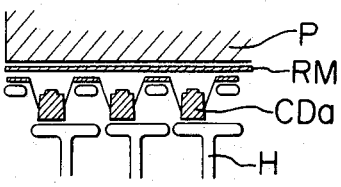
Figure 4:
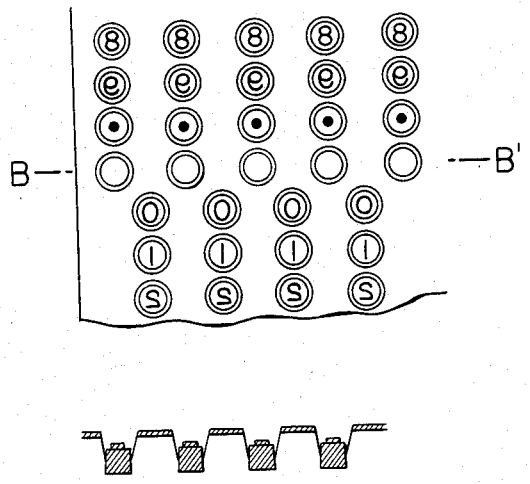
FIG. 4 is a planar developed view representing the arrangement of typefaces.

Referring to FIG. 1 showing the printer of the present invention in a lateral cross-sectional view, printing means for example a character drum CD is structured in such a manner that the typeface CDa thereon is normally maintained in a position retracted from the outer periphery of said drum CD as shown in FIG. 2 which is a cross-sectional view along the line A—A' in FIG. 1 or in FIG. 3 indicating details of said typeface, and that said typeface returns spontaneously to the original position thereof after being hit by a hammer, as will be explained later. As shown in FIG. 4, the outer periphery or surface of said character drum CD is divided into two portions on which there are respectively provided the faces CDa for printing characters in even and odd columns. The character drum is composed of an organic elastic material such as rubber integrally with the typefaces thereon, as shown in FIG. 4. The character drum may be reinforced with a suitable drum provided with openings corresponding to the locations of said faces.

Figure 5:
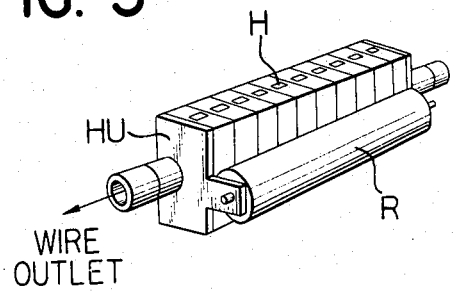
FIG. 5 is a perspective view of a hammer unit.

A hammer unit HU is provided inside the character drum CD, as shown in FIG. 2, and is provided with hammer heads H wide enough to hit the faces CDa in an even column and an odd column on the character drum CD (see FIGS. 3A and 4). The hammers H are actuated by means for example of solenoids which thrust the corresponding faces toward outside of the character drum CD. The solenoid used includes a moveable member as disclosed in U.S. Pat. No. 3,994,382, and the hammer is juxtaposed with the solenoid as shown in FIG. 5.

Said hammer unit HU is further provided on a part thereof with a roller R which causes the faces CDa to be projected from the outer periphery of the character drum CD whereby said faces CDa are coated with printing ink by means of an ink roller IR.

A belt B transmits the driving force of a motor M to the character drum CD thereby placing the same into rotary motion, as shown in FIGS. 1 and 2.

A recording material or paper RM is supplied, by means of a rubber roller GR and a pinch roller PR, onto a platen P against which the faces CDa of the character drum CD are driven by the hammers H to perform the printing function. FIG. 5 shows a perspective view of the hammer unit HU and the roller R.

The faces CDa on the character drum CD are selected for example by detecting the holes Ho provided integrally with said character drum CD by means, for example, of a light source CS and a detector PD receiving the light beam from said light source. Said light source and detector are provided on one end of said hammer unit HU, as shown in FIG. 1.

Figure 6:
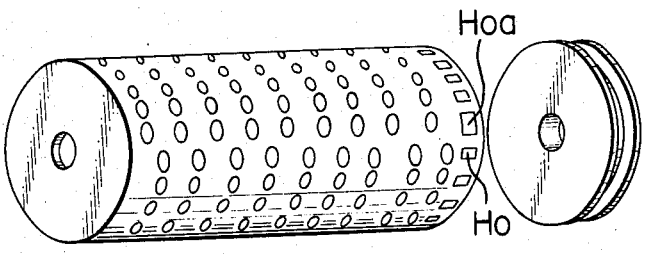
FIG. 6 is a perspective view of a face wheel.

As shown in FIG. 6, in order to allow identification of the boundary between the faces for odd columns and those for even columns, the hole Hoa corresponding to the last face "-" among those for even columns is made larger than the other holes so as to provide a broader pulse.

Figure 7:
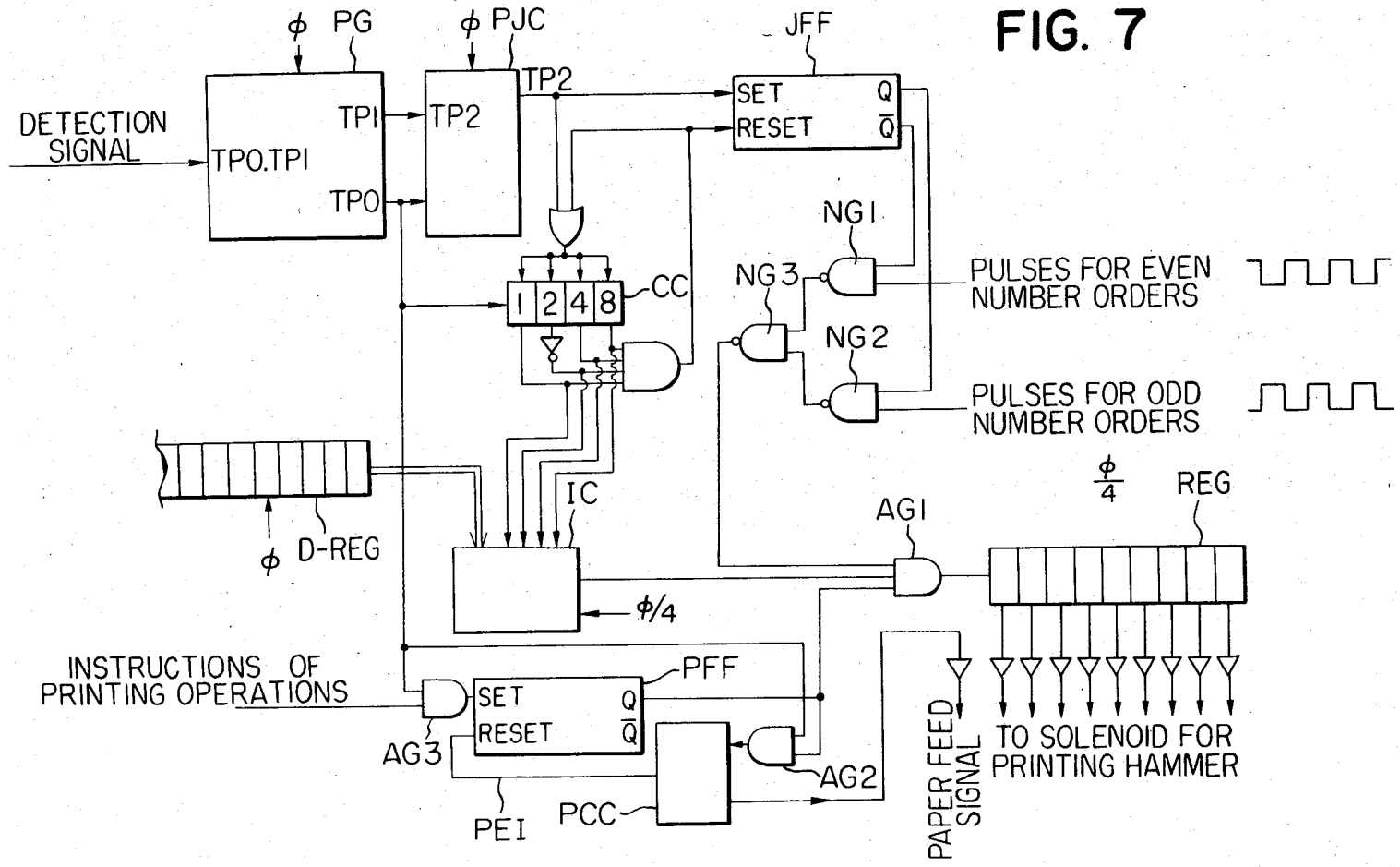
FIG. 7 is a diagram of a control circuit.
Figure 8:
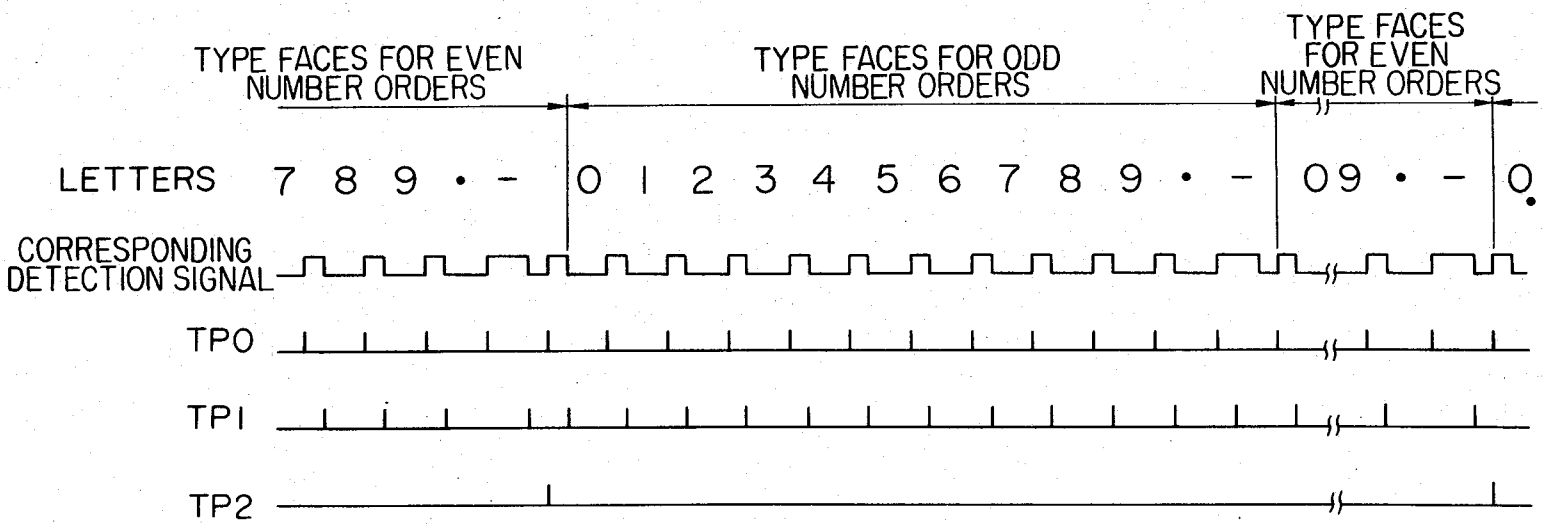
FIG. 8 is a wave form diagram.

Now referring to FIG. 7 illustrating a control circuit for the printer of the present invention, a pulse generator PG receives the output of the detector (FIG. 8) corresponding to the detection of the holes Ho (FIG. 6) provided on the character drum CD and generates timing pulse signals TPo and TP1 respectively corresponding to the start and end of said output signal.

The pulse corresponding to the final face "-" among those for the even column is made broader than other pulses in order to allow identification of the boundary between the faces for even columns and those for odd columns. A pulse judging circuit PJC compares these pulses with standard pulses $\phi$ of the circuit and generates a pulse TP2 (FIG. 8) allowing exclusively identification of the pulse TPo corresponding to the face "0" of the odd columns. An even-odd judging flip-flop JFF is turned on and off by means of said pulse TP2, corresponding to the position of the character drum CD.

By means of said flip-flop JFF the data stored in a data register D-Reg is divided into the odd and even columns and stored in a print register Reg. More specifically the even or odd digit positions (even or odd number orders) of the data register D-Reg are transferred to the print register Reg when the content of said data register D-Reg is found to be identical with that of a character counter CC by means of an identifying circuit IC.

The content of said register Reg is supplied by an unrepresented means to the hammer unit HU to perform the printing operation. In the drawing AG1 to AG3 are AND gates, and NG1 and NG3 are NAND gates.

Upon release of a print instruction, a print flip-flop PFF is set in synchronization with the character pulse to shift the AND gate AG1 to ON state thereby enabling input to the print register Reg.

Successively a print control counter PCC is activated to start counting.

Also the pulse signals TPo are supplied to the character counter CC to start counting. The content of said counter CC is compared, by means of the identifying circuit IC, with the content of the data register D-Reg, said identifying circuit IC performing comparison of all the content of data register D-Reg while the content of the character counter CC remains the same. The results of the comparison are supplied, through the AND gate AG1 opened by the even digit position pulses or odd digit position pulses, to the print register Reg. In this manner the register Reg memorizes the data of even digits or odd digits in the data register D-Reg which coincide with the content of the character counter CC.

In this manner the comparison is conducted alternatively for the even digit and odd digit positions of the data register D-Reg and starting from "0" to "-" by means of said character counter CC, and the printing operation is performed in the order of "0", "1", "2", . . . , "-".

More specifically, in case, for example, the data register D-Reg stores data "0" from the lowermost digit position to the third digit position from the right and in case the print timing is selected for printing of the characters in the odd columns, the identifying circuit identifies the data of these three digit positions and supplies the output signals to the AND gate AG1, but the input of "0" of second digit position into the register Reg is blocked by the odd digit position pulse. As the result, high level signals corresponding to "0" in the first and third digit positions are memorized in the determined positions in the register Reg, all other positions memorizing low level signals.

Successively the content of the register Reg is supplied to the solenoids of the hammer unit HU whereby the hammers H hit the faces CDa to press the recording material RM against the platen P to perform a printing operation.

Upon completion of the printing of odd columns in the above-mentioned manner, the printing of "0" in the even columns is successively conducted in a similar manner.

As the printing is achieved by displacement of the face CDa, by means of hammer H, toward the recording medium RM, said medium can be prevented from ink deposition from the unactivated faces and can therefore be kept clean.

The print control counter PCC, upon completion of counting of a predetermined number, releases a paper feed signal to advance the recording medium. Thereupon a print end instruction PEI is released to reset the print flip-flop PFF and to terminate the function of print control counter PCC.

As mentioned above, the prevention of undesirable ink deposition onto the recording medium can be achieved so long as the faces are constructed to be displaceble by the impact of the hammers. The home or original position of said faces, therefore, can also be located outside the external periphery of the character drum CD.

It will be apparent from the foregoing description that the composition of the present invention allows reduction of the hammer driving circuits, to prevent the mutual interference of hammers and to improve the packing density of the printed characters.

Furthermore, the printer of the present invention allows dispensation of a smudge preventing means as the face is located retracted from the outer periphery of the character drum, and design of a smaller printer due to the presence of hammers inside the character drum.

Although the foregoing description is specifically directed to an embodiment designed for successive printing of characters in the order of "0", . . . , "-", it is to be understood that the face structure displaceable from a home position to an activated position according to the present invention is also applicable to a printer wherein the character drum is replaced by a plurality of character rings and the printing operation is performed after completion of setting of all the character rings in desired printing positions.

What we claim is:

1. A printer for printing characters on a recording medium, comprising:

a rotatable printing drum having at one end thereof an opening, having an outer surface with a first portion and a second portion at a location on said drum circumferentially spaced from said first portion, said first and second portions respectively providing thereon a plurality of first sets of type faces and a plurality of second sets of type faces, each said first set being offset with respect to one of said second sets, and being longer in the direction of its rotating axis than its diameter;

hammer means arranged within said printing drum for striking a single type face at a time and having a plurality of hammer heads dimensioned with a sufficient width to define first and second striking portions such that the type faces of one said first sets are arranged to be struck by said first striking portion and the type faces of said second set offset from said one first set are arranged to be struck by said second striking portion;

inking means opposed to said printing drum for depositing ink thereon; and a rotatable roller mounted on said hammer means within said printing drum for projecting said type faces beyond the outer surface of said printing drum into contact with said inking means.

2. A printer according to claim 1, wherein said first and said second sets of type faces are characters for printing even and odd columns, respectively.

3. A printer according to claim 1, further comprising means for detecting the rotation of said printing drum and means for selectively printing with said first and second sets of type faces using said detecting means.

4. A printer for printing characters on a recording medium, comprising:

a rotatable printing drum having at one end thereof an opening, having an outer periphery with a first portion and a second portion, said first and second portions having a plurality of first sets of type faces and a plurality of second sets of type faces, respectively, and being longer in the direction of its rotating axis than its diameter;

hammer means arranged within said printing drum and having a plurality of hammers, each said hammer being capable of actuation to impact, selectively, a type face of one of said first sets and a type face of one of said second sets, thereby projecting the selected type face beyond the outer periphery of said printing drum;

an ink roller opposed to said printing drum;

a rotatable roller mounted on said hammer means within said printing drum for projecting said type faces beyond the outer periphery of said printing drum into contact with said ink roller; and signalling wire means arranged within said printing drum for providing actuation signals to said hammer means, said signalling wire means being insertable into said opening at the end of said printing drum.

5. A printer according to claim 4, wherein said hammer means includes a portion containing said signalling wire means.

6. A printer according to claim 4, wherein said first portion of said printing drum is disposed at a location on said printing drum circumferentially spaced from said second portion.

7. A printer according to claim 6, wherein further comprising means for selectively driving said hammer means by detecting the rotational position of said printing drum.

8. A printer according to claim 6, wherein said first and second sets of type faces are characters for printing even and odd columns, respectively.

9. A printer according to claim 4, wherein each said first set of type faces is offset with respect to one of said second sets of type faces and each said hammer has a head with a width sufficient for impacting said first and second sets of type faces at different portions of said head.

* * * * *

UNITED STATES PATENT AND TRADEMARK OFFICE

CERTIFICATE OF CORRECTION

PATENT NO. : 4,655,130

DATED : April 7, 1987

INVENTOR(S) : HIROSHI KYOGOKU, ET AL.

It is certified that error appears in the above-identified patent and that said Letters Patent is hereby corrected as shown below:

COLUMN 1

Line 47, "An another" should read --Another--.

COLUMN 3

Line 24, "NG1 and NG3" should read --NG1 to NG3--.

COLUMN 4

Line 19, "displaceble" should read --displaceable--.

COLUMN 6

Line 15, "wherein further" should read --further--.

Signed and Sealed this

Twenty-second Day of September, 1987

*Attest:*

DONALD J. QUIGG

*Attesting Officer* *Commissioner of Patents and Trademarks*